US009702583B2

(12) United States Patent
Dobi

(10) Patent No.: US 9,702,583 B2
(45) Date of Patent: Jul. 11, 2017

(54) METHOD AND APPARATUS FOR HEATING A STORED LIQUID

(71) Applicant: Stevan Dobi, Edmonton (CA)

(72) Inventor: Stevan Dobi, Edmonton (CA)

(73) Assignee: Pityu Controls Inc. (CA)

( * ) Notice: Subject to any disclaimer, the term of this patent is extended or adjusted under 35 U.S.C. 154(b) by 346 days.

(21) Appl. No.: 13/774,323

(22) Filed: Feb. 22, 2013

(65) Prior Publication Data

US 2013/0220237 A1 Aug. 29, 2013

Related U.S. Application Data

(60) Provisional application No. 61/602,630, filed on Feb. 24, 2012.

(51) Int. Cl.

| | |
|---|---|
| ***F24H 1/00*** | (2006.01) |
| ***F24H 1/08*** | (2006.01) |
| ***F22B 1/02*** | (2006.01) |
| ***F24H 1/20*** | (2006.01) |
| ***F24H 9/20*** | (2006.01) |
| ***F22D 1/00*** | (2006.01) |
| ***F22D 3/02*** | (2006.01) |

(52) U.S. Cl.

CPC ..... *F24H 1/08* (2013.01); *F22B 1/021* (2013.01); *F22D 1/006* (2013.01); *F22D 3/02* (2013.01); *F24H 1/0027* (2013.01); *F24H 1/208* (2013.01); *F24H 9/2035* (2013.01); *F24H 2240/00* (2013.01)

(58) Field of Classification Search

CPC ..... F24H 1/08; F24H 4/04

USPC ..... 122/18.1, 32, 15.1, 125

See application file for complete search history.

(56) References Cited

U.S. PATENT DOCUMENTS

| | | | | |
|---|---|---|---|---|
| 2,095,017 A * | 10/1937 | Wilkes | F24H 4/04 122/15.1 |
| 2,781,174 A * | 2/1957 | Smith | F24D 3/08 122/15.1 |
| 4,957,214 A * | 9/1990 | Lenny | 220/220 |
| 7,726,298 B2 | 6/2010 | St. Denis | |

(Continued)

FOREIGN PATENT DOCUMENTS

| | | |
|---|---|---|
| CA | 2196842 | 12/2000 |
| CA | 2421384 | 12/2009 |
| CA | 2741581 | 5/2011 |

*Primary Examiner* — Alissa Tompkins
*Assistant Examiner* — John Bargero
(74) *Attorney, Agent, or Firm* — Scott T. Griggs; Griggs Bergen LLP

(57) ABSTRACT

A self-contained portable heating system to heat a stored liquid in a storage tank to a desired temperature is provided. The system can comprise operatively connected components such as a generator to power a burner that can transfer energy from a combustion product, from for example, a fuel supplied by an attached fuel tank, to a heat transfer fluid through the use of a boiler. The heat transfer fluid can transfer heat from the boiler to a heat exchanger which can then transfer heat to the stored liquid in the tank. The tank can also comprise a circulating pump that can circulate the heat transfer fluid and an expansion tank that can receive the heat transfer fluid when it expands as a result of being heated. In some embodiments, the heating components can be supplied separately from storage tank so that they can be retrofit onto an existing tank.

18 Claims, 6 Drawing Sheets

(56) References Cited

U.S. PATENT DOCUMENTS

| | | | | |
|---|---|---|---|---|
| 8,418,718 | B2 | 4/2013 | Hebblethwaite | |
| 2006/0196958 | A1* | 9/2006 | Dancey et al. | 237/67 |
| 2008/0173260 | A1* | 7/2008 | Lange | 122/31.1 |

* cited by examiner

METHOD AND APPARATUS FOR HEATING A STORED LIQUID

PRIORITY STATEMENT & CROSS-REFERENCE TO RELATED APPLICATIONS

This application claims priority from co-pending U.S. Patent Application No. 61/602,630 and filed Feb. 24, 2012; which is hereby incorporated by reference for all purposes.

TECHNICAL FIELD OF THE INVENTION

The present disclosure is related to the field of methods and apparatus for heating a stored liquid, in particular, methods and apparatus for heating a stored liquid using a self-contained, portable, heating systems for liquid storage tanks.

BACKGROUND OF THE INVENTION

Large storage tanks, for example four hundred barrel tanks, are used to store various liquids at hydrocarbon drilling and completion sites. The stored liquids can be used for different applications, for example, large amounts of water are used in hydraulic fracturing (fracing) operations, for pre-heating equipment, and in on-site mud tanks during drilling operations.

Storage tanks used on-site are often bare steel and the tanks can freeze in cold environments. Problems occur when the temperature of the stored liquid approaches its respective freezing point. The freezing liquid can expand which can lead to damage of the tank as well as the equipment the liquid is to be delivered through and to (for example: piping, tanks, and downstream equipment). In addition, if the liquid cannot be used because it is frozen, the specific application cannot be performed which will result in down-time at the site.

It is known to use external heating equipment, such as steam heaters, to heat the liquid in the storage tank to keep it above its freezing point. Current methods and systems, however, require many external components, are cumbersome, inefficient and expensive, are difficult to transport, and have problems with the stored liquid freezing between components. Current methods and systems using water boilers have difficulties as the boiler water itself can freeze. This can be overcome by replacing the boiler water with glycol when the boiler is not in use or is transported. This process is onerous, however, as the boiler water can be difficult to drain and it is not always desirable to work with glycol. Existing methods and systems using steam coils and similar technologies are only powerful enough to barely keep the liquid stored in a tank above the freezing temperature. This problem is magnified during periods of high liquid usage and very cold environments.

In some contexts it is desirable to reduce or eliminate the volume of a stored liquid on-site to avoid further required storage and/or transportation of the liquid. Present methods and apparatuses used to reduce or eliminate stored liquids on-site, however, are inadequate.

In addition, it is desirable to prevent/avoid the freezing of sewage within sewage systems to prevent damage to the sewage system and reduce downtime. Present methods and apparatuses used to prevent/avoid the freezing of sewage within sewage systems, however, are inadequate.

Accordingly, there is a need to provide apparatuses and methods for heating a stored liquid that overcomes the short-comings of the prior art.

SUMMARY OF THE INVENTION

A self-contained portable heating system to heat a stored liquid in a storage tank to a desired temperature is provided. The system can comprise operatively connected components such as a generator to power a burner that can transfer energy from a combustion product, from for example, a fuel supplied by an attached fuel tank, to a heat transfer fluid through the use of a boiler. The heat transfer fluid can transfer heat from the boiler to a heat exchanger. The heat exchanger can then transfer heat from the heat transfer fluid to the stored liquid in the tank. The tank can also comprise a circulating pump that can circulate the heat transfer fluid and an expansion tank that can receive the heat transfer fluid when it expands as a result of being heated. When the heat transfer fluid cools, the expansion tank can discharge the heat transfer fluid back into the system, particularly to the heat exchanger and the boiler. In some embodiments, the heating components can be supplied separately from storage tank so that they can be retrofit onto an existing tank.

The apparatus and methods can allow for a heating system that can prevent a liquid stored in a storage tank from freezing in cold environments. In some embodiments, the apparatus and methods can allow for an operator-free heating system that can heat the liquid stored in a storage tank to a desired temperature. In some contexts, the liquid to be heated can be heated to the point of vaporization as desired. In some contexts the apparatus and methods can be used to heat sewage in a sewage system such that the sewage does not freeze and render the sewage system inoperable. In some embodiments, the apparatus and methods can allow for a heating system either created to be retrofit or integral with a storage tank to create a portable heated storage tank.

It can be noted that the term piping as used throughout is to mean a fluid connection and can encompass any means, as understood by one skilled in the art, which can provide a fluid connection as the context requires.

Broadly stated, in some embodiments, a self-contained portable apparatus is provided for heating a liquid comprising: a power source for powering a burner firing into a boiler, the boiler in fluid connection with a circulating pump; and wherein the boiler is configured to heat a heat transfer fluid which is pumped by the circulating pump to a heat exchanger, the heat exchanger operatively configured to transfer heat to the liquid and is fluidly connected to the boiler in such a manner to return cooled heat transfer fluid to the boiler to be reheated; the system further comprising an expansion tank to allow for the expansion of the heat transfer fluid as it is heated.

Broadly stated, in some embodiments, a method is provided for heating a stored liquid comprising: powering a burner firing into a boiler; using the fired boiler to heat a heat transfer fluid; circulating the heated heat transfer fluid through a heat exchanger; contacting the heat exchanger with the stored liquid to be heated such that the stored liquid is heated.

Broadly stated, in some embodiments, a self-contained portable apparatus is provided for heating a liquid, the system to be retrofit to a storage tank, the system comprising: a power source for powering a burner firing into a boiler, the boiler in fluid connection with a circulating pump; wherein the boiler is configured to heat a heat transfer fluid which is pumped by the circulating pump to a first attachment configured to attach to a heat exchanger; a second attachment configured to attach downstream from the heat exchanger and is fluidly connected to the boiler in such a manner to return cooled heat transfer fluid to the boiler to be reheated; and a third attachment configured to attach to an expansion tank to allow for the expansion of the heat transfer fluid as it is heated.

DETAILED DESCRIPTION OF THE INVENTION

Methods and apparatus for heating a stored liquid are provided. The stored liquid could be any fluid requiring heating or stabilization of temperature, for example but not limited to, water, fracing fluid, oil, water/oil emulsions, sewage, etc., and in some cases, can be a sludge, slush, slurry, or composite of solid/liquid/gas.

Figure 1:
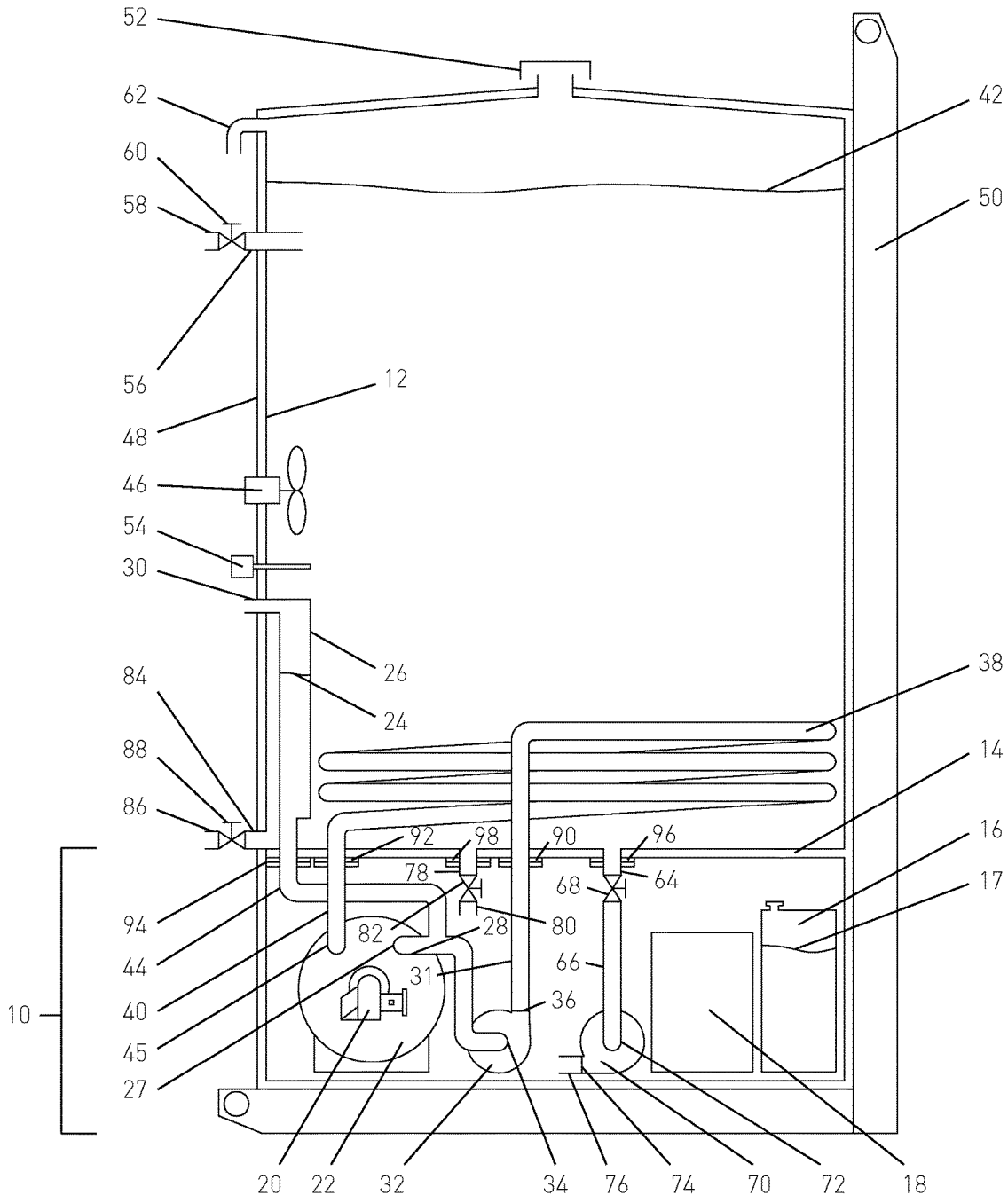
FIG. 1 is a side elevation cross-section view depicting an embodiment of an apparatus for heating and storing a liquid.

Referring now to FIG. 1, a heating system/apparatus is shown. In some embodiments, heating system 10 can be integral with storage tank 12. Some components of heating system 10 can be separated from storage tank 12 by separation 14. The term 'tank' is used merely for convenience and can include any number of storage apparatuses or systems to hold fluids and would include four hundred barrel tanks and other standard oilfield tanks, but also include sewage systems and sewers.

Heating system 10 can comprise fuel tank 16 to store fuel 17 to operate heating system 10. In some embodiments, fuel can comprise a hydrocarbon, such as diesel, liquid gas, propane, or natural gas. Fuel tank 16 can be operatively connected to, and used to power, generator 18. Fuel tank 16 and/or generator 18 can also be operatively connected to, and power, burner 20. In turn, burner 20 can be operatively connected to, and power, boiler 22. In some embodiments, alternative power sources, including, but not limited to, external power sources or other internal power sources such as those known to one skilled in the art, can be used in place of generator 18. In the case of an external power source (such as an external generator or power grid), system 10 can comprise appropriate power conduits and connections to allow for the external power source to power system 10. The term power source, as used herein, can include these appropriate power conduits and connections.

Boiler 22 can be used to increase the temperature of a heat transfer fluid 24. Boiler 22 can be fluidly connected to an expansion tank 26 via, for example, boiler discharge 27 and first piping 28. Heat transfer fluid 24 can expand as heated through expansion tank 26 towards vent 30 and be vented to the atmosphere through a wall of storage tank 12. In some embodiments, heat transfer fluid 24 can comprise any appropriate fluid that will not flush into the atmosphere or vaporize at a working temperature. In some embodiments, heat transfer fluid 24 can comprise an appropriate oil or an appropriate glycol as would be known in the art, while in other embodiments, heat transfer fluid 24 can comprise steam.

Heat transfer fluid 24 can also be drawn through boiler discharge 27 and second piping 31 towards a circulating pump 32 by pump suction 34 and be discharged from pump 32 by pump discharge 36. Circulating pump 32 can be powered by a common power source, for example, generator 18. Pump discharge 36 can be fluidly connected to heat exchanger 38 by, for example third piping 40. Heat exchanger 38 can be in the form of a spring or a panel or a flat coil or any other configuration, as would be understood by one skilled in the art, to transfer heat from heat transfer fluid 24 to stored liquid 42. Heat transfer fluid 24 can return from heat exchanger 38 to boiler 22 through a fluid connection, for example, fourth piping 44 and boiler return 45. It would be understood that pump 32 can be in-line with the heat exchanger 38 circuit, and can be located, for example, downstream of heat exchanger 38.

Some embodiments can include agitator 46 which can be used to agitate stored liquid 42, to mix stored liquid 42 of varied temperature, and assist in the heat transfer from heating system 10. Agitator 46 can be in the form of a motorized propeller which can be attached to the inside of storage tank 12 and, in some embodiments, be powered by generator 18.

Some embodiments can include insulation 48 surrounding storage tank 12 to assist in retaining heat from heating system 10 within stored liquid 42. Some embodiments can include skid 50 which can, for example, be an L-shaped skid, and can extend along the upright length of storage tank 12 and along the bottom of heating system 10. In embodiments where heating system 10 can be retro-fit onto an existing storage tank 12, a module skid extension 51 (see FIG. 3) can extend along the upright length to separation wall 14 and along the bottom of heating system 10. Skid 50 or skid extension 51 can allow for the easy transportation of heating system 10 and storage tank 12 by loading and unloading off of trucks. Some embodiments can also include breather 52 which can act as a vent for stored liquid 42 and allow for storage tank 12 to remain unpressurized.

Some embodiments can include temperature sensor 54 connected to a temperature control on a panel external to heating system 10. The temperature control can be operatively connected to burner 22 such that burner 22 is turned off or on in response to the control. Sensor 54 can be configured to read the temperature of stored liquid 42 and the control panel can be used to adjust the heat produced by heating system 10 to allow for stored liquid 42 to remain at a desired temperature or temperature range.

Storage tank 12 can also comprise tank inlet 56 which can allow the tank to be filled with stored liquid 42 through fifth piping 58 and inlet valve 60 prior to the application or continuously during the running of the application. Storage tank overflow 62 can be provided at the top of storage tank 12. If storage tank 12 is over filled, excess stored liquid 42 can escape from overflow 62, preventing over-filling and alerting the filler to close inlet valve 60.

Storage tank 12 can also comprise outlet 64 to allow for stored liquid 42 to be removed from storage tank 12 through sixth piping 66 and inlet valve 68 to be used in the desired application. In-line with sixth piping 66, can be a second circulating pump 70 with suction 72 and discharge 74, where the discharge 74 of second circulating pump 70 can lead to seventh piping 76, which, in-turn can lead to the desired downstream application or drainage.

Storage tank 12 can also comprise drain 78 to allow for stored liquid 42 to be drained to the outside of storage tank 12 through eighth piping 80 and drain valve 82 after the desired application is completed, so that storage tank 12 can be moved or relocated while empty if desired.

Storage tank 12 can also comprise equalization line 84 to allow for storage tank 12 to be fluidly connected, through ninth piping 86 and equalization valve 88, to at least one additional storage tank and for stored liquid 42 to be filled or drained from storage tank 12 to an equalization level.

Figure 2:
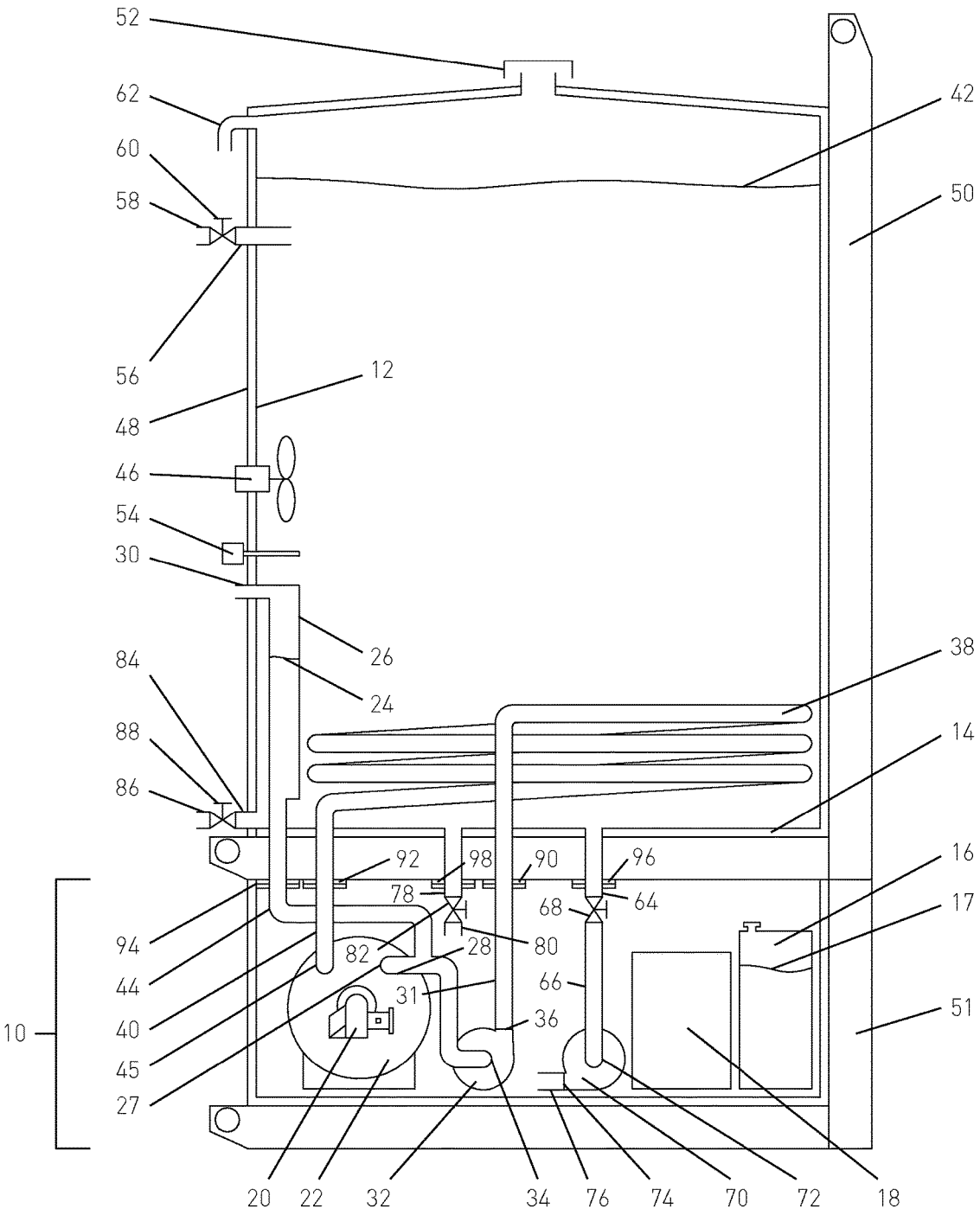
FIG. 2 is a side elevation cross-section view depicting a further embodiment of an apparatus, retrofit on a storage tank, for heating a liquid.
Figure 3:
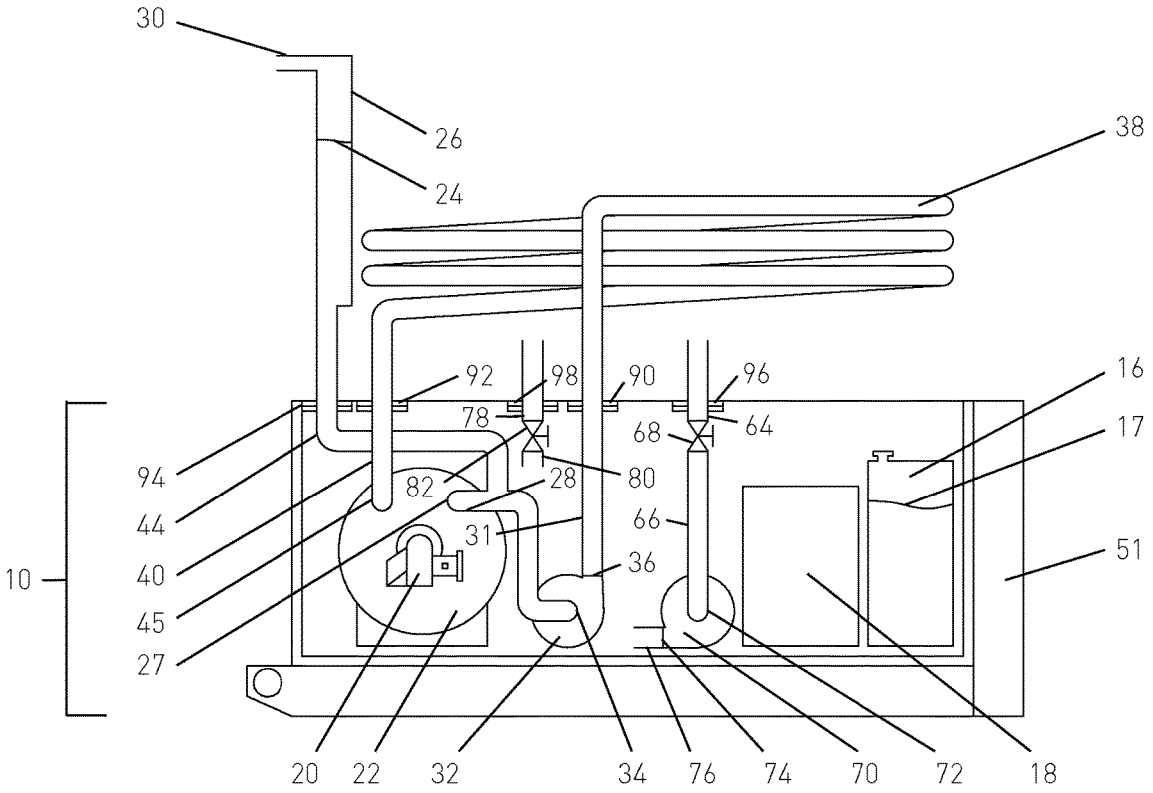
FIG. 3 is a side elevation cross-section view depicting an embodiment of an apparatus for heating a liquid to be retrofit on a storage tank.

Referring now to FIGS. 2 and 3, a further embodiment of heating system 10 is shown which can be retrofit to storage tank 12. FIG. 2 shows heating system 10 retrofit on storage tank 12, while FIG. 3 shows heating system 10 in the absence of storage tank 12. Fluid connectors/attachments, as known to those skilled in the art, can be used to connect the piping of heating system 10 to the piping of components that would be internal to storage tank 12. For example, a first connector/attachment 90 can be used to create a fluid connection along second piping 31, a second connector/attachment 92 can be used to create a fluid connection along third piping 40, a third connector/attachment 94 can be used to create a fluid connection along fourth piping 44, a fourth connector/attachment 96 can be used to create a fluid connection along sixth piping 66, and a fifth connector/attachment 98 can be used to create a fluid connection along eighth piping 80. In some embodiments, the fluid connectors/attachments can be disposed on separation wall 14.

In operation, the heating system 10 can use a heat transfer fluid 24 and heat exchanger 38 to exchange energy from heat transfer fluid 24 to stored liquid 42. Heat transfer fluids used, for example oil or glycol, can be capable to withstand extreme low temperatures, such as −60° C. Therefore, the heat transfer portion of the heating system 10 does not need to be drained to prevent freezing as it does not use water or fluids with freezing temperatures near 0° C. Heating system 10 and/or storage tank 12 can be open to the atmosphere, for example through vent 30 and breather 52 respectively, and operate below the boiling point of water, unlike steam based systems. As such, heating system 10 would not fall under legal or policy regulations governing pressurised vessels and would not require operator attendance. In some embodiments, heating system 10 and/or storage tank 12 can be closed to the atmosphere, for example where storage tank 12 comprises a closed sewage system, or other such situations.

As a result, it is possible to have a self-contained portable heating system to heat liquid stored in a storage tank which can prevent the stored liquid from freezing, heat and store the liquid at a desired temperature, vaporize the liquid where desired, and be operator-free. As would be apparent to one skilled in the art, a further advantage of the present disclosure is that heating system 10 can be operated in the absence of stored liquid 42, without heating system 10 burning out. This is not the case for some of the methods and apparatus described in the prior art.

In some embodiments, multiple storage tanks 12 can be fluidly connected to one another through equalization line 84, ninth piping 86, and equalization valve 88. In this situation, one heating system 10 can heat the stored liquid 42 of multiple storage tanks 12. This can be particularly advantageous if some of the connected storage tanks 12 do not have their own functioning heating system 10. The redundancy created by connecting multiple storage tanks 12 in parallel with at least one heating system 10 can allow for stored liquid 42 of multiple storage tanks 12 to remain unfrozen (or at a constant temperature, or vaporized, as the case may be), even in the situation where there is not a functional heating systems 10 connected directly with each storage tank 12.

For some applications, for example when using heated fluids to preheat fracing equipment, heating system 10 can be used to heat a volume of stored liquid 42 which is less than the volume of storage tank. As would be understood by one skilled in the art, heating a smaller volume of stored liquid 42 with the same energy input can be done in a shorter period of time than heating a larger volume of stored liquid 42. In addition, it would be understood that heating a smaller volume of stored liquid 42 with the same energy and the same amount of time will result in a higher temperature achieved by the stored liquid 42.

Figure 4:
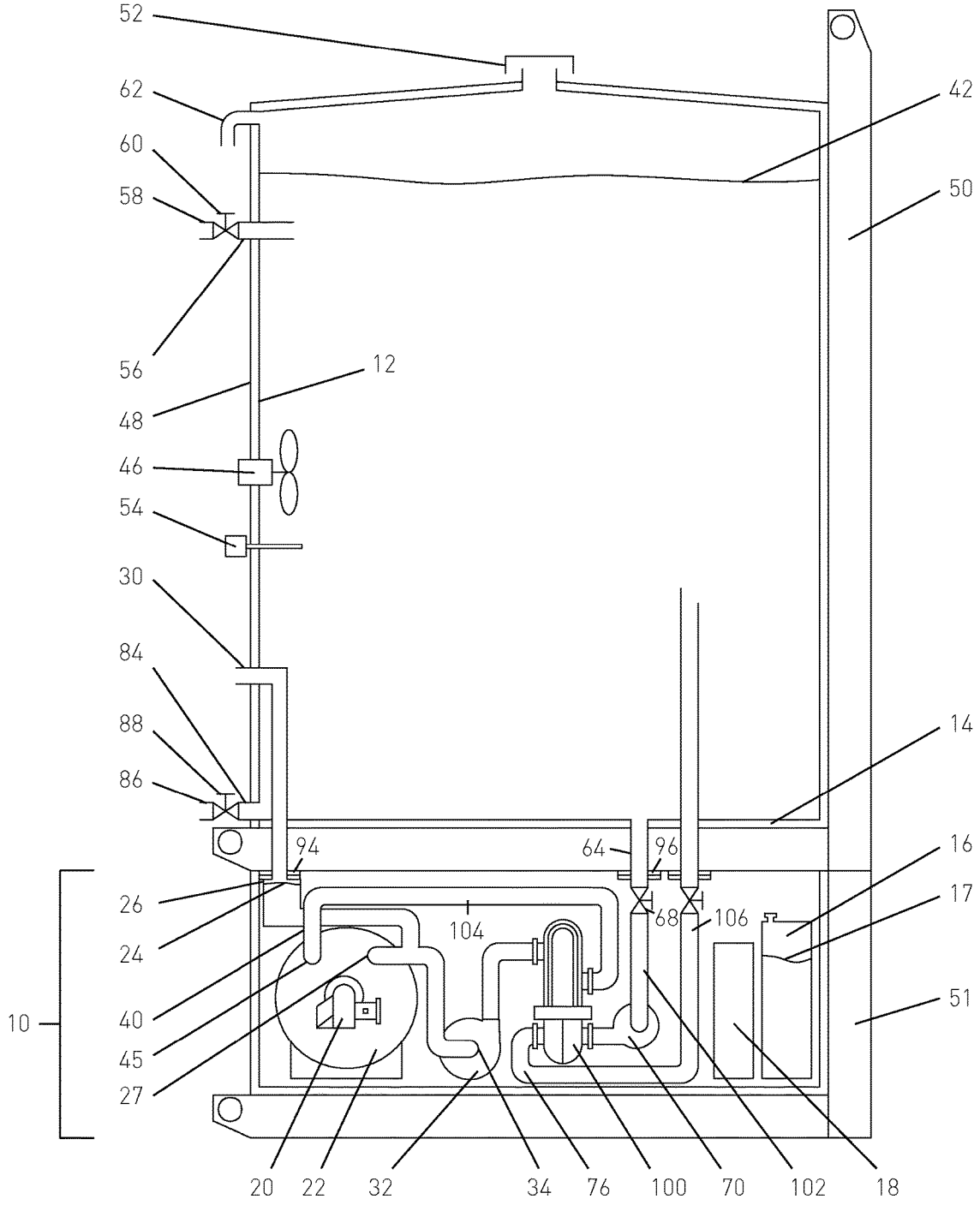
FIG. 4 is a side elevation cross-section view depicting a further embodiment of an apparatus, retrofit on a storage tank, for heating a liquid.
Figure 5:
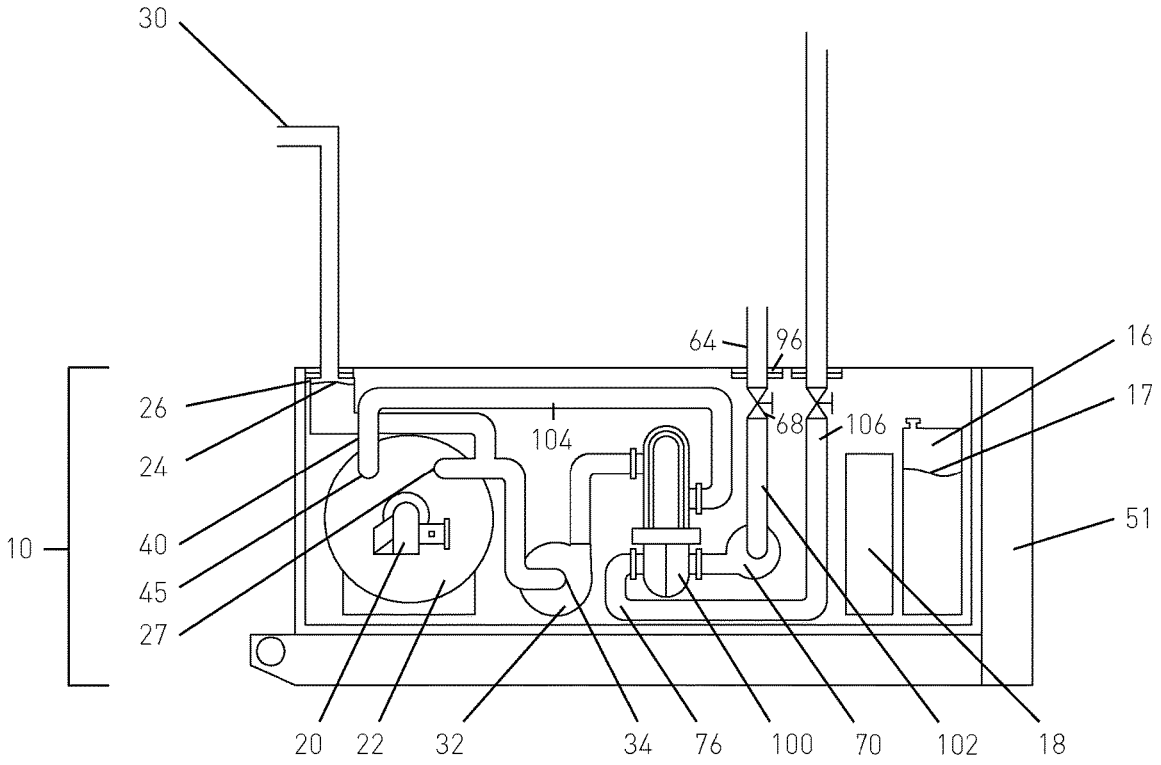
FIG. 5 is a side elevation cross-section view depicting an embodiment of an apparatus for heating a liquid to be retrofit on a fluid storage system.

Referring now to FIG. 4 and FIG. 5, in some embodiments stored liquid 42 from storage tank 12 can be circulated through a heat exchanger 100 within heating system 10 below tank. In these embodiments, the coil-type heat exchanger 38 can be replaced with heat exchanger 100 and heating system 10 can become further self-contained. As such, heating system 10 can be retrofit to existing storage tanks 12 with reduced difficulty. In some embodiments, heat exchanger 100 can be of a shell-and-tube type design, for example. Stored liquid 42 can exit storage tank 12 through tenth piping 102 and run parallel with a heat transfer fluid 24 circuit 104 heated by boiler 22 and burner 20 to and pumped through heat exchanger 100. Once heated, stored liquid 42 can be pumped back into storage tank 12 through eleventh piping 106. As described previously, fluid connectors/attachments, as known to those skilled in the art, can be used to connect the piping of heating system 10 to the piping of components that would be internal to storage tank 12.

Figure 6:
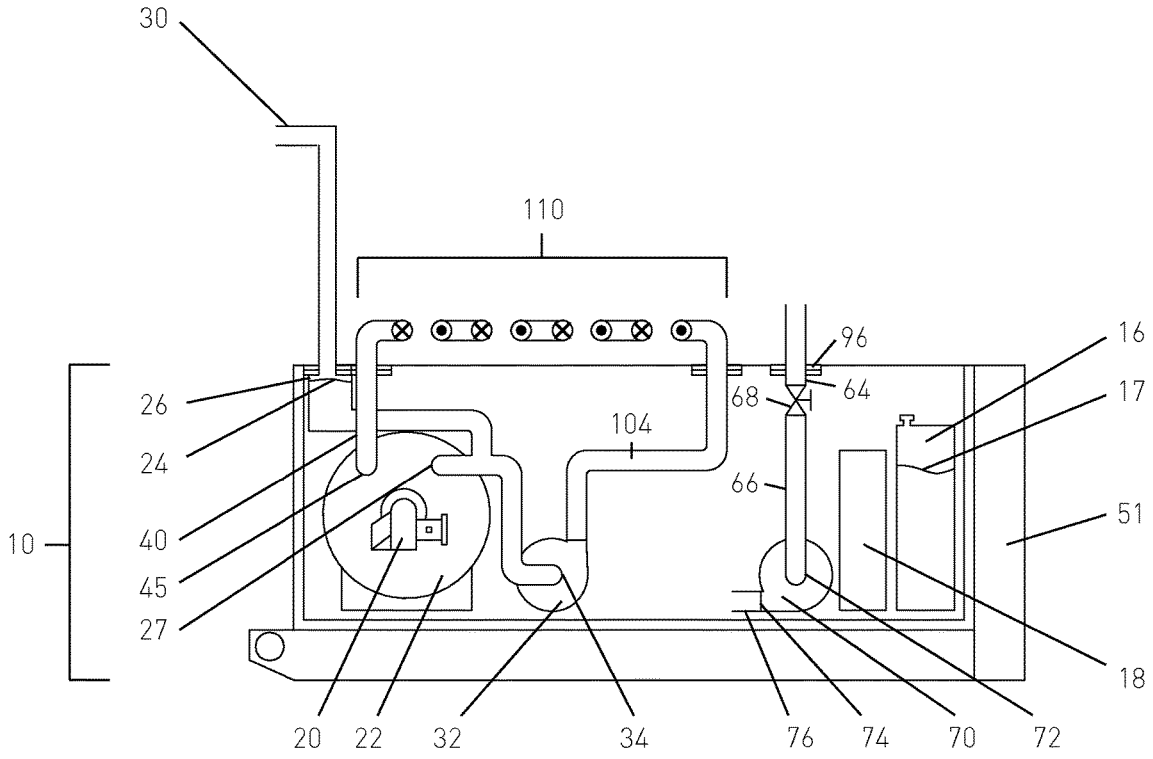
FIG. 6 is a side elevation cross-section view depicting a further embodiment of an apparatus for heating a liquid to be retrofit on a fluid storage system.

Referring now to FIG. 6 a further embodiment of an apparatus for heating a liquid to be retrofit on a storage tank is provided. In some embodiments, coil-type heat exchanger 38 can be replaced with flattened heat exchanger 110. Heated transfer fluid 24 can flow through flattened heat exchanger 110 to heat stored liquid 42 in storage tank 12. For example, flattened heat exchanger 110 can comprise a set of continuous tubes, shown here as flowing into (an X in a circle) and out of (a dot in a circle) the page, substantially parallel to each other and forming a heat exchange surface to heat stored liquid 42. Heat transfer fluid 24 can return from flattened heat exchanger 110 to boiler 22 through a fluid connection, for example, piping 40 and boiler return 45.

Stored liquid 42 can be any variety of liquid that would require heating or temperature stability. In some embodiments, stored liquid 42 can be, for example, a water and oil emulsion. Storage tanks 12 and heating system 10 can be used to separate water from oil in the emulsion. While separating an emulsion, it can be important to avoid agitation, mixing, or unsettling of the liquid. As such, it would not generally be desirable to pump an emulsion through heat exchanger 100.

In some embodiments, storage tank 12 and heating system 10 can be used as a vaporizer of stored liquid 42. For example, stored water can be vaporized by continually increasing its temperature using heating system 10 to be maintained at or near the liquid's vaporization point. As a result stored liquid can be vaporized and stored liquid 42 will not require further storage or costly transport away from the storage site.

In some embodiments, heating system 10 can be retrofit to a sewer or sewage system (not shown) and used to heat sewage (stored liquid 42) in order to prevent sewage system from freezing and becoming inoperable.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

What is claimed is:

1. A self-contained portable apparatus for heating a liquid stored inside a storage tank, the apparatus comprising:

a power source for powering a burner firing into a boiler, the boiler in fluid connection with a circulating pump, wherein the power source is a generator operatively attached to a fuel tank for providing fuel to activate the generator;

wherein the boiler is configured to heat a heat transfer fluid which is pumped by the circulating pump to a heat exchanger, the heat exchanger operatively configured to transfer heat to the liquid and is fluidly connected to the boiler in such a manner to return cooled heat transfer fluid to the boiler to be reheated;

the apparatus further comprising an expansion tank to allow for the expansion of the heat transfer fluid as it is heated, wherein the expansion tank is disposed within the storage tank and vented to the atmosphere through a wall of the storage tank by a vent passing through an orifice defined by the wall of the storage tank; and the apparatus further comprising a separation member for supporting the storage tank above the boiler, wherein the separation member defines an aperture for through passage of an attachment connecting the boiler and the heat exchanger, and wherein the separation member partially defines a compartment containing the boiler.

2. The apparatus of claim 1 further comprising the storage tank disposed above and around the heat exchanger.

3. The apparatus of claim 1 further comprising a skid for holding and carrying the heating apparatus.

4. The apparatus of claim 1 further comprising an agitator disposed on the apparatus configured to agitate the liquid to be heated.

5. The apparatus of claim 1 wherein the heat exchanger is a type selected from the group consisting of a coil, shell-and-tube, and flattened.

6. The apparatus of claim 1 wherein the expansion tank is open to the atmosphere.

7. The apparatus of claim 1 wherein the heat transfer fluid is oil or glycol.

8. The apparatus of claim 2 further comprising a second circulating pump and fluid connection extending from within the storage tank to the outside of the storage tank to transfer the liquid in and out of the storage tank.

9. A method of heating a stored liquid in a storage tank, the method comprising:

supplying fuel from a fuel tank to activate a generator;

using the activated generator for powering a burner firing into a boiler contained within a compartment partially defined by a separation member supporting the storage tank above the boiler;

using the fired boiler to heat a heat transfer fluid;

allowing the heated heat transfer fluid to expand through an expansion tank that is disposed within the storage tank and vented to the atmosphere through a wall of the storage tank by a vent passing through an orifice defined by the wall of the storage tank;

circulating the heated heat transfer fluid through a heat exchanger; and contacting the heat exchanger with the stored liquid to be heated such that the stored liquid is heated.

10. The method of claim 9 further comprising the steps of:

sensing the temperature of the stored liquid with a temperature sensor disposed within the stored liquid and;

using a temperature control to stop the operation of the burner when a desired temperature of the stored liquid is reached.

11. The method of claim 9 further comprising the steps of:

powering an agitator disposed within the stored liquid with the activated generator;

agitating the liquid with the agitator.

12. A self-contained portable apparatus for heating a liquid in a storage tank, the apparatus to be retrofit to the storage tank, the apparatus comprising:

a power source for powering a burner firing into a boiler, the boiler in fluid connection with a circulating pump, wherein the power source is a generator operatively attached to a fuel tank for providing fuel to activate the generator;

wherein the boiler is configured to heat a heat transfer fluid which is pumped by the circulating pump to a first attachment configured to attach to a heat exchanger;

a second attachment configured to attach downstream from the heat exchanger and is fluidly connected to the boiler in such a manner to return cooled heat transfer fluid to the boiler to be reheated;

a third attachment configured to attach to an expansion tank to allow for the expansion of the heat transfer fluid as it is heated;

a separation member for supporting the storage tank above the boiler, wherein the separation member defines an aperture for through passage of the first attachment, and wherein the separation member partially defines a compartment containing the boiler; and wherein, when the apparatus is retrofit to the storage tank, the expansion tank is disposed within the storage tank and vented to the atmosphere through a wall of the storage tank, by a vent passing through an orifice defined by the wall of the storage tank.

13. The apparatus of claim 12 further comprising an agitator disposed on the apparatus configured to agitate the liquid to be heated.

14. The apparatus of claim 12 wherein the heat exchanger is a type selected from the group consisting of a coil, shell-and-tube, and flattened.

15. The apparatus of claim 12 further comprising a skid for holding and carrying the storage tank, wherein the skid extends along an upright length of the storage tank and along a bottom of the separation member, and defines a further aperture for through passage of the first attachment.

16. The apparatus of claim 14 wherein the heat transfer fluid is oil or glycol.

17. The apparatus of claim 12 further comprising a second circulating pump and fluid connection extending to a fourth attachment configured for attaching to within the storage tank and to the outside of the storage tank to transfer the liquid in and out of the storage tank.

18. The apparatus of claim 15 further comprising a skid extension for holding and carrying the apparatus, wherein the skid extension extends along an upright length of the apparatus to the separation member and along a bottom of the apparatus, and wherein the skid is removably attachable to the skid extension.

* * * * *